US006718901B1

(12) United States Patent
Abbott et al.

(10) Patent No.: US 6,718,901 B1
(45) Date of Patent: Apr. 13, 2004

(54) OFFSHORE DEPLOYMENT OF EXTENDABLE DRAFT PLATFORMS

(75) Inventors: Phillip A. Abbott, Katy, TX (US); Colin Hough, Houston, TX (US); Stephane Alain Le Guennec, Houston, TX (US); Jerome Q. Burns, Tucson, AZ (US); Pierre-Armand Thomas, Puteaux (FR)

(73) Assignee: Technip France, Courbevoie (FR)

( * ) Notice: Subject to any disclaimer, the term of this patent is extended or adjusted under 35 U.S.C. 154(b) by 0 days.

(21) Appl. No.: 10/292,310

(22) Filed: Nov. 12, 2002

(51) Int. Cl.[7] ..... B63B 35/44
(52) U.S. Cl. ..... 114/264; 114/265
(58) Field of Search ..... 114/264, 265, 114/266; 405/196, 200, 201, 203, 205

(56) References Cited

U.S. PATENT DOCUMENTS 6,024,040 A 2/2000 Thomas ..... 114/264
6,196,767 B1 3/2001 Thomas ..... 405/203
6,524,032 B2 2/2003 Russell et al.

*Primary Examiner*—Stephen Avila
(74) *Attorney, Agent, or Firm*—Klein, O'Neill & Singh, LLP

(57) ABSTRACT

Deploying an offshore oil and gas production platform comprises placing a buoyant equipment deck on a buoyant pontoon so that elongated legs on the pontoon, each comprising a buoyant float, extend movably through respective openings in the deck. Chains extending from winches on the deck are reeved through fairleads on the pontoon and connected back to the deck. The chains are tightened to secure the deck to the pontoon for conjoint movement to an offshore location. The chains are loosened and the pontoon and leg floats ballasted so that the pontoon and leg floats sink below the floating deck. The chains are then re-tightened until pawls on the leg floats engage the deck. The buoyancy of at least one of the pontoon and leg floats is increased so that the deck is thereby raised above the surface of the water. The chains are connected to mooring lines around an offshore well site, and the raised deck and submerged pontoon are maintained in a selected position over the site with the winches.

10 Claims, 6 Drawing Sheets

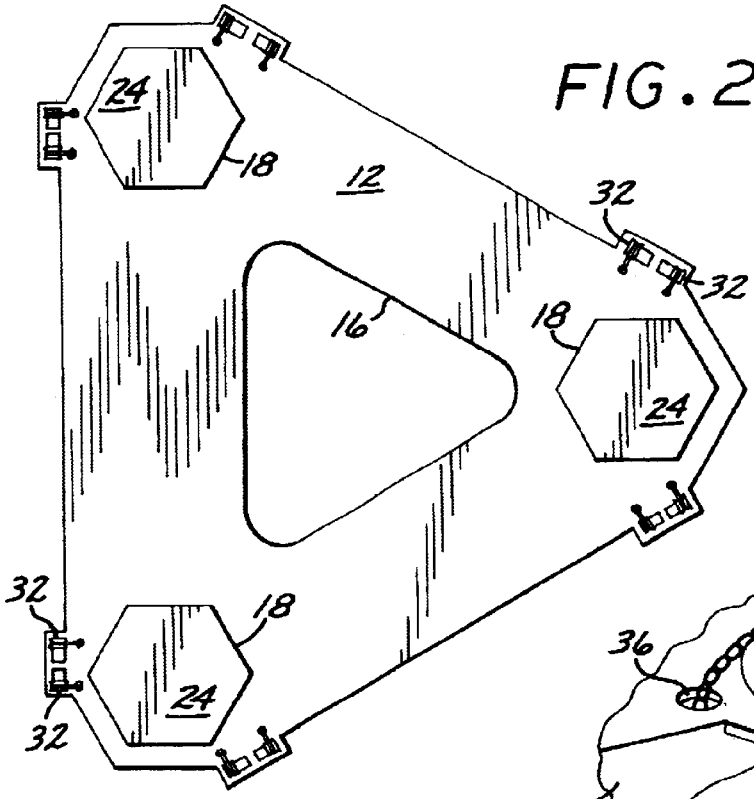
FIG. 2
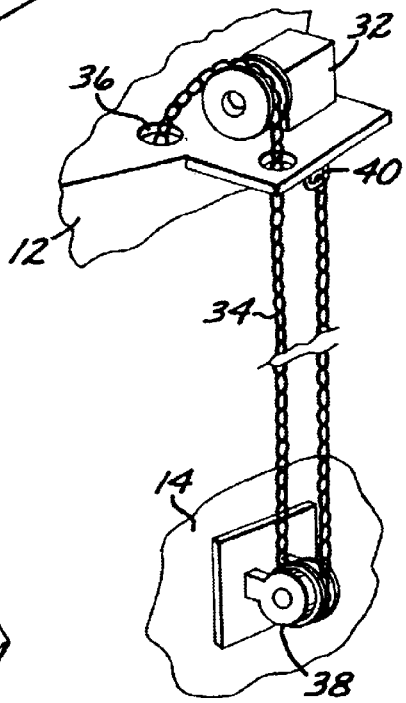
FIG. 4
FIG. 3
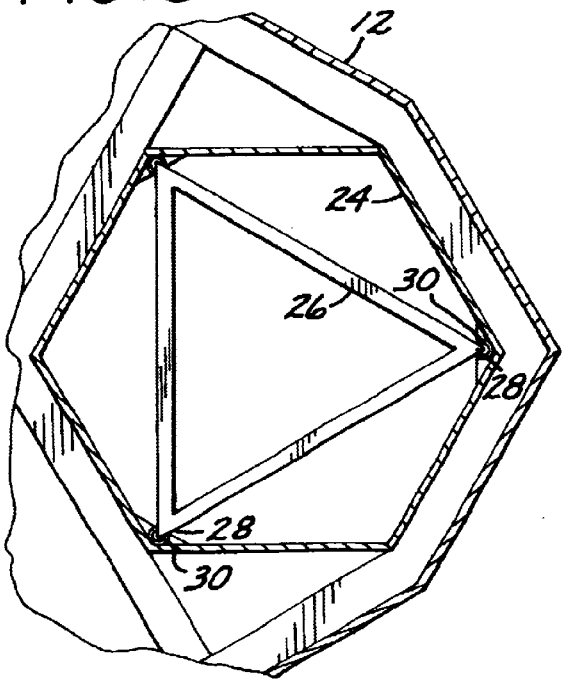

OFFSHORE DEPLOYMENT OF EXTENDABLE DRAFT PLATFORMS

CROSS-REFERENCE TO RELATED APPLICATIONS

Not Applicable

FEDERALLY-SPONSORED RESEARCH OR DEVELOPMENT

Not Applicable

BACKGROUND

1. Technical Field

This invention pertains to oil and gas exploration and production in general, and in particular, to a method for the assembly and deployment of an extendable draft platform for deep water offshore exploration and production of oil and gas.

2. Related Art

Development of deep water offshore oil and gas fields such as are found in, e.g., the Gulf of Mexico and the North Sea present substantial challenges to the industry. Early production schedule requirements favor inshore integration and commissioning and a year-round deployment capability, even in winter months. Moreover, the ability to use so-called "dry trees" and steel catenary risers ("SCRs") requires that the motion of the deployed structures be relatively small, even in rough seas.

In response to these challenges, a number of different types of tethered, floating platforms have been proposed for use in offshore oil and gas exploration and production, such as are described in U.S. Pat. Nos. 6,024,040—Thomas; 6,196,767—Thomas; and U.S. application Ser. No. 09/686, 535 now abandoned; all of which are commonly owned by the assignee hereof, and the teachings of which are incorporated herein by this reference. While these platforms have to some extent been responsive in meeting some of the above challenges, they still leave areas in which improvement is needed.

For example, to obtain low motion characteristics in a floating facility, e.g., those in which dry-tree well completions and/or the use of SCRs is contemplated, it is necessary to use a deep draft vessel and/or heave-suppression devices. Because of these requirements for a large draft, current methods for deploying oil-industry-related platforms that have favorable motion characteristics in deep water are typically effected sequentially, and require offshore heavy lift crane vessels ("HLCVs") or "float-over" deck-mating techniques that are inherently risky. These methods also require that the weather conditions be generally favorable, and a substantial amount of time can be lost waiting for an opportunity to complete the commissioning and mating operations. Therefore, more rapid, cost-effective and less risky methods are needed for the provisioning and deployment of an offshore platform.

SUMMARY

In accordance with the present invention, a method for the assembly and deployment of an extendable draft platform ("EDP") to a deep water offshore location is presented that is rapid, cost-effective, and less risky. The method combines the advantages of both "jack-up" and "semisubmersible" platforms, permits many of the deployment steps to be effected in parallel, rather than sequentially, and is self-contained, i.e., eliminates the need for auxiliary equipment and vessels such as HLCVs or float-over deck-mating techniques.

The novel method comprises providing a buoyant equipment deck having a plurality of leg openings through it and a plurality of chain winches mounted thereon. Each winch has the proximal end of a mooring chain wound onto it. In one exemplary preferred embodiment, the equipment deck of the EDP comprises a triangular, barge-like hull structure having a triangular central opening, with the leg openings being located inboard of the apices of the hull.

An adjustably buoyant pontoon is also provided that, in one exemplary preferred embodiment, comprises a deep, triangular-shaped hull having a central opening and approximately the same peripheral outline as the equipment deck. The pontoon has a plurality of fairleads disposed around its lateral periphery and a plurality of columns, or legs, extending upwardly therefrom. Each leg comprises an adjustably buoyant float, which may be circular or polygonal in cross-section. Optionally, each leg may include a lower portion comprising an elongated, open truss, which, in one possible embodiment, may have a triangular cross-section.

The deck is placed on the pontoon such that the pontoon supports the deck and each of the legs extends up through a respective one of the leg openings in the deck. The distal ends of the mooring chains are reeved through corresponding ones of the fairleads on the pontoon and then connected back to the deck. The chains are then wound in with the winches so that the deck is pulled down tightly onto and closely coupled with the pontoon. This tightly coupled "piggyback" configuration enables the deck and pontoon to be moved quickly and securely as a unit over a surface of a body of water, e.g., by towing, to a first offshore location, without the need for any additional sea fastenings between the deck and pontoon.

A plurality of pawls are provided on each of the leg floats. These pawls, which may comprise compression pawls or shear pawls, are movable between a retracted position, which permits relative vertical movement between the legs and the deck, and an extended position, in which they can be engaged with the deck to prevent relative vertical movement between the legs and the deck. This arrangement, in combination with the mooring chains and winches, enables the pontoon to be submerged to a "working" depth below, and the deck to be raised to a "working" height above, the surface of the water at the first offshore location, with the following procedure.

The buoyancy of the pontoon and the leg floats is reduced, e.g., by ballasting them with sea water, such that they begin to sink. The chains are simultaneously wound out with the winches while maintaining a positive tension in them, so that the deck is floated onto the surface of the water while the pontoon and legs sink below the surface to selected depths. The pawls on the leg floats are then moved to the extended position and the chains are wound back in with the winches such that the pontoon and the legs are pulled back up toward the deck, until the pawls engage the deck, thereby preventing further relative movement between the legs and the deck. The buoyancy of at least one of the pontoon and the leg floats is then increased such that the deck is thereby raised to a selected working height above the surface of the water. In one exemplary preferred embodiment, means are provided between the deck and the pawls for distributing the load imposed by the deck on respective ones of the leg floats uniformly around a circumference of the floats when the pawls engage the deck.

After the EDP has been extended to the above "working" configuration, it is towed to an offshore well site having a plurality of mooring lines anchored to the seabed around it. There, the deck is connected to the leg floats in a more permanent manner, e.g., by welding, to prevent relative movement between the deck and the leg floats independently of the tension in the mooring chains. The distal ends of the mooring chains may then be disconnected from the deck and connected to the ends of respective ones of the mooring lines such that the platform can be maintained in a selected working position over the well site with the winches.

As may be seen from the above, the platform can be provided in a retracted, shallow draft configuration suitable for assembly, outfitting and towing in shallow coastal waters, and can then be easily and quickly reconfigured in deeper offshore waters to a very deep-draft, low-motion platform using simple, onboard ballasting and mooring equipment, thereby resulting in a rapid, cost-effective, and less risky deployment, without the need for auxiliary vessels and equipment.

A better understanding of the above and many other features and advantages of the present invention may be obtained from a consideration of the detailed description thereof below, particularly if such consideration is made in conjunction with the appended drawings.

DESCRIPTION OF THE DRAWINGS

FIG. 2 is a top plan view of the EDP shown in FIG. 1;

FIG. 3 is a partial cross-sectional view through one of the legs of the EDP, as revealed by the section taken along the lines 3—3 in FIG. 1;

FIG. 4 is a perspective detail view of a mooring chain, winch and fairlead of the EDP;

DETAILED DESCRIPTION

Figure 1:
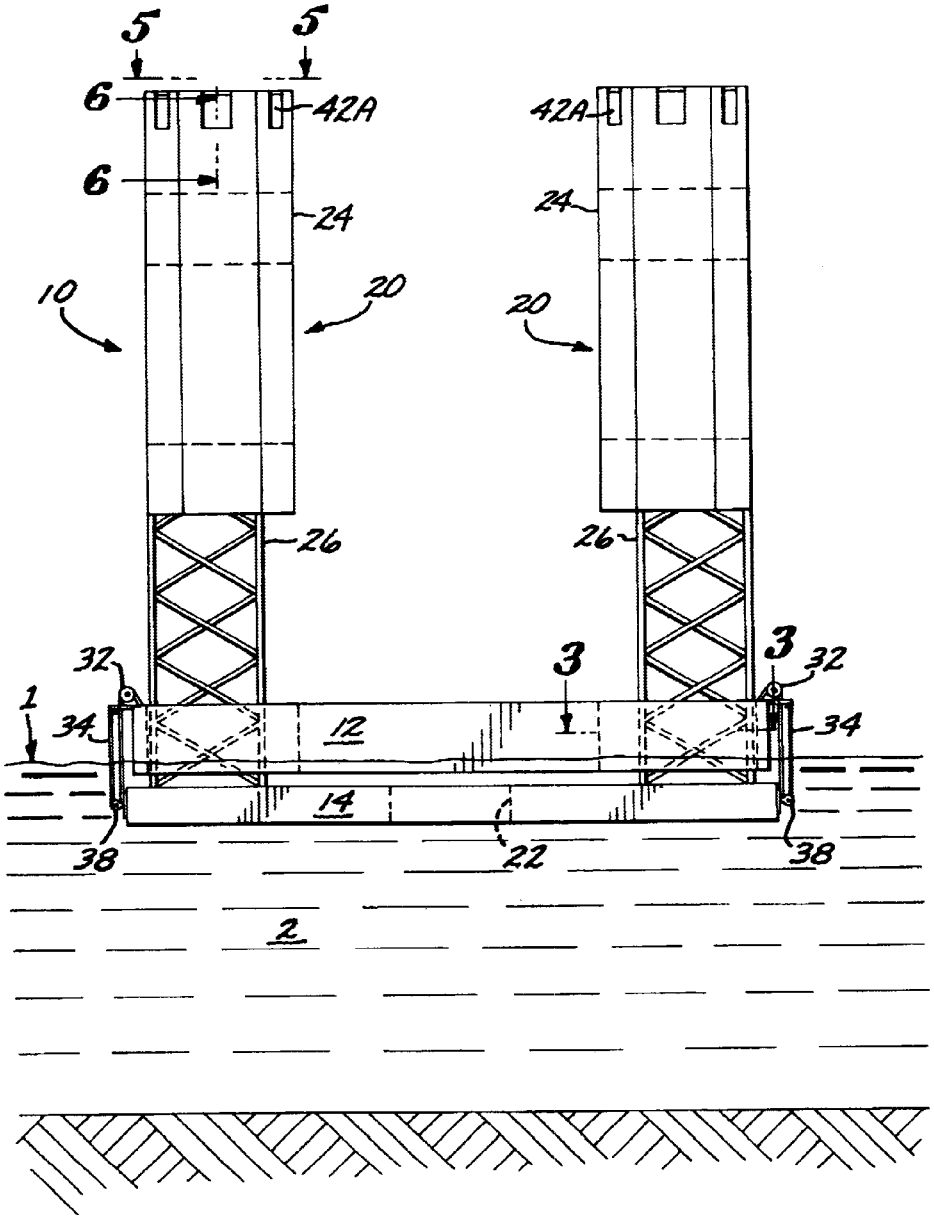
FIG. 1 is an elevation view of a floating extendable draft platform ("EDP") in accordance with an exemplary preferred embodiment the present invention with its legs and pontoon shown in a retracted position.

An extendable draft platform ("EDP") 10 in accordance with the present invention is shown in the elevation view of FIG. 1 floating on the surface 1 of a body of water 2 in a retracted, shallow-draft configuration. The EDP 10 comprises a buoyant equipment deck 12 and an adjustably buoyant pontoon 14 movably associated with the deck in the manner described below.

As illustrated in the top plan view of FIG. 2, in one possible exemplary embodiment, the deck 12 may comprise a triangular, barge-type hull structure that provides support and buoyancy for oil and gas drilling and/or production equipment (not illustrated) that mounts on the upper surface thereof. At the center of the exemplary deck 12, an opening 16 is provided into which a riser system support truss and well bay (not illustrated) may be installed. The deck 12 also includes a plurality of leg openings 18, the function of which is described below, located slightly inboard of respective ones of the apices of the triangular structure. However, it should be understood that the deck 12 can incorporate a shape other than triangular, depending on the particular circumstances at hand.

The pontoon 14 includes a plurality elongated columns, or legs 20, that extend upwardly from it and through the leg openings 18 of the deck 12. The pontoon 14 is a deep hull that provides buoyancy and is divided into a number of ballast tanks that can be selectively flooded with and emptied of sea water ballast with, e.g., pumps and/or high pressure air during deployment. Similar to the deck 10, the pontoon 14 also incorporates a central "moonpool" 22 (see FIG. 1) through which risers may pass via keel joints (not illustrated). In the particular exemplary embodiment illustrated, the pontoon 14 is triangular in shape, and has about the same periphery as that of the deck 12, although, as with the latter, the pontoon's size and shape can be varied in accordance with the particular circumstances at hand.

Each of the legs 20 comprises an adjustably buoyant float 24 that provides trim buoyancy for the EDP 10. In one possible embodiment (not illustrated), the legs 20 may each comprise a single, watertight column from top to bottom, or alternatively, may be made up of a number of vertical, watertight cylinders. In the particular exemplary embodiment illustrated in the figures, each of the legs 20 includes an upper portion comprising an adjustably buoyant float 24 and a lower portion comprising an elongated, open-truss structure 26 that extends the leg to the length required to achieve the necessary depth of the pontoon 14 when it is fully submerged or extended below the deck 12.

Like the pontoon 14, the leg floats 24 incorporate one or more ballast or trim tanks that can be selectively flooded with and emptied of sea water to adjust their buoyancy. In the particular exemplary embodiment illustrated in FIG. 3, the leg floats 24 and leg truss structures 26 are respectively hexagonal and triangular in cross-section. However, as should be understood, these two structures may respectively incorporate other, functionally equivalent cross-sectional shapes, e.g., round or polygonal. In any case, it is desirable that the shape of the leg openings 18 in the deck 12 conform to that of the legs 20, so that the legs are free to move vertically within the openings and relative to the deck with conjoint vertical movement of the pontoon 14. To this end, the legs 20 are preferably provided with a leg guidance system comprising a plurality of legmounted, semi-cylindrical guide rails 28 (three per leg in the exemplary embodiment illustrated in FIG. 3) that slide vertically within complementary guide-shoe saddles 30, one per rail 28, mounted in the leg openings 18.

In accordance with the EDP 10 deployment method described below, the deck 12 is provided with a plurality of mooring chain jacks, or winches, 32, as illustrated in FIGS. 1, 2 and 4. In the particular embodiment illustrated in the figures, the deck 12 is equipped with twelve of the winches 32, i.e., four adjacent to each of the legs 20, but this number can be varied in accordance with particular design needs. The proximal end of a high-strength mooring chain 34 is wound onto each of the winches 32, and is then fed to or from a chain storage locker 36 located in the deck 12 adjacent to the winch. The distal ends of the chains 34 are each reeved through a corresponding one of a plurality of fairleads 38 mounted around the periphery of the pontoon 14 and then connected to a becket 40 on the deck 12. This arrangement enables the pontoon 14 to be lowered from and raised toward the deck 12 with the mooring chains 34 and winches 32 alone, without the need for a separate rack and pinion system of the type used by conventional platforms.

The EDP 10 of the present invention lends itself well to a rapid, flexible deployment method. Unlike conventional platforms, which involve operations that must be effected in sequence, many of the deployment steps of the present invention can be carried out in advance of or in parallel with the installation of the EDP 10. Thus, FIG. 1 illustrates the equipment deck 12, the pontoon 14, and the legs 20 assembled together in a retracted configuration. Each of the individual components of the EDP 10, including the leg floats 24, can be separately fabricated in a number of different shipyards and dry-transported to a shallow water or even dry dock assembly facility. Alternatively, it is possible to transport the completely assembled deck 12, pontoon 14 and leg floats 24, as shown in FIG. 1, onboard a submersible heavy lift vessel ("HLV"). In yet another alternative embodiment, the leg floats 24 can be separately transported on a second HLV if scheduling dictates it. In any case, upon their arrival at the assembly facility, the deck 10 and the pontoon 14 can be floated off and brought immediately alongside the dock. The topside equipment and facilities can be installed on the deck 12 and the leg floats 24 connected to the top of the leg trusses 26 using land-based lifting equipment. Indeed, most if not all of the hook-up and commissioning operations can be completed in a protected, shallow-water, inshore facility.

After commissioning, the chains 34 are wound in with the winches 32 so that the deck 12 is pulled down tightly onto and closely coupled with the pontoon 14, as illustrated in FIG. 1. This tightly coupled piggyback configuration enables the deck 12 and pontoon 14 to be moved securely as a unit over the surface 1 of a body of water 2, e.g., by towing with tugs, from the assembly yard to a first offshore location, without need for any additional sea fastenings between the deck and pontoon.

Figure 7:
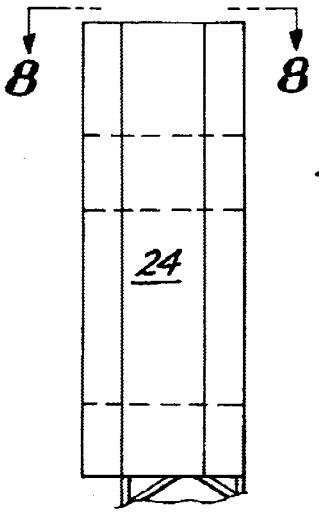
FIG. 7 is a partial elevation view of one of the adjustably buoyant leg floats of the EDP.
Figure 8:
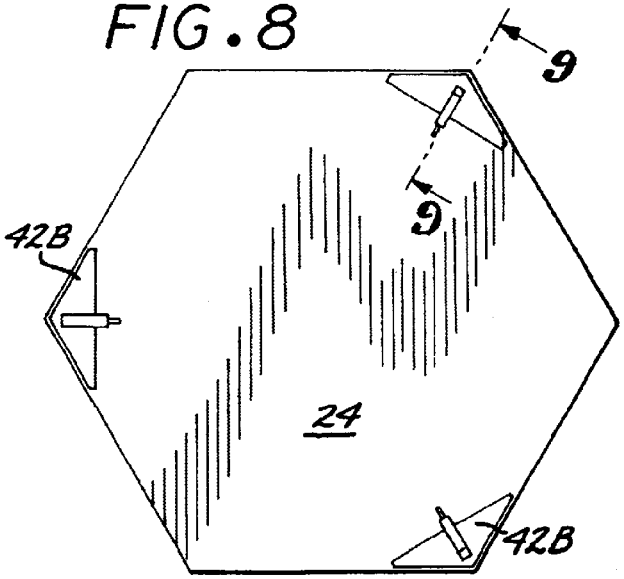
FIG. 8 is a top plan view of the adjustably buoyant leg float of FIG. 7, as seen along the lines 5—5 therein, and showing a plurality of shear pawls mounted on the float.
Figure 9:
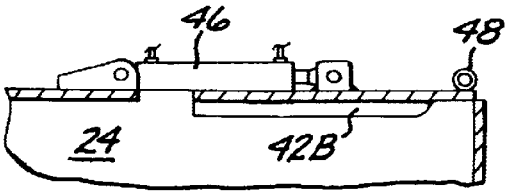
FIG. 9 is a partial cross-sectional view through one of the shear pawls of FIG. 8, as revealed by the section taken therein along the lines 9—9.

At the first, deeper water location, the EDP 10 is extended into a "working" configuration by respectively lowering the pontoon 14 below, and raising the deck 12 above, the surface 1 of the water 2, and then temporarily locking the legs 20 to the deck to prevent further relative movement between the legs and deck. To effect this temporary locking arrangement, a plurality of movable locking pawls 42A or 42B are provided on each of the leg floats 24 at the upper end thereof The pawls 42 may optionally comprise either compression pawls 42A, as illustrated in FIGS. 1, 5 and 6, or shear pawls 42B, as illustrated in FIGS. 7–9.

Figure 5:
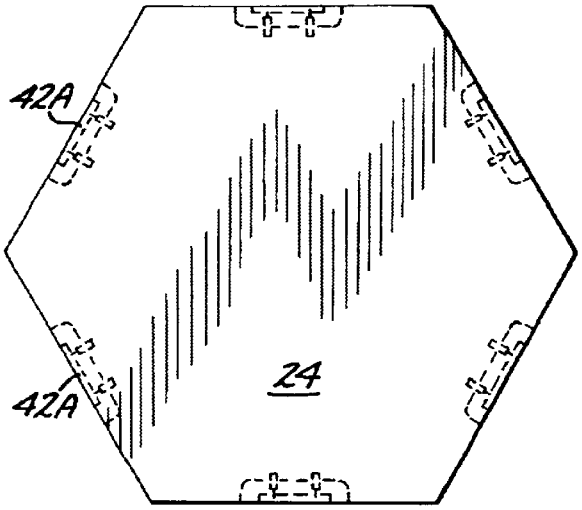
FIG. 5 is a top plan view of one of the adjustably buoyant leg floats of the EDP as seen along the lines 5—5 in FIG. 1 and showing a plurality of compression pawls contained therein.
Figure 6:
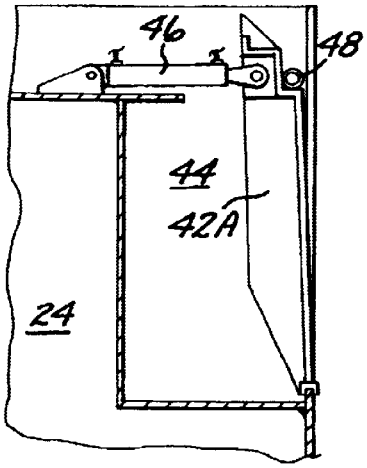
FIG. 6 is a partial cross-sectional view of one of the compression pawls of FIG. 5, as revealed by the section taken along the lines 6—6 in FIG. 1.
Figure 12:
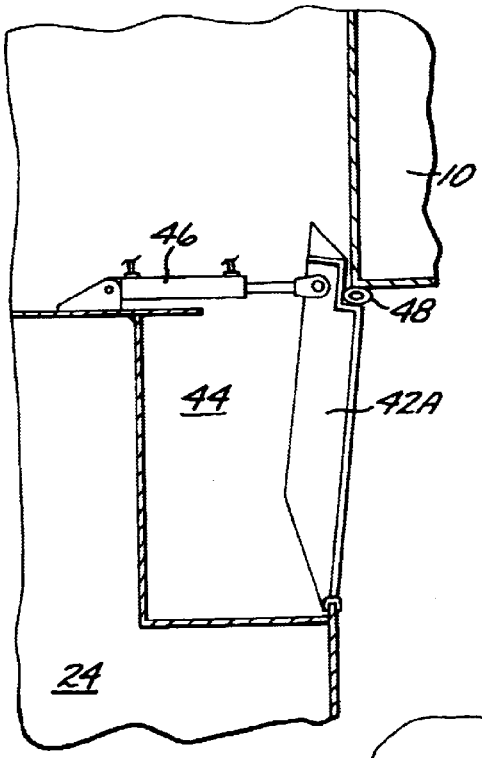
FIG. 12 is a partial cross-sectional view of a compression pawl, as revealed by the section taken along the lines 12—12 in FIG. 11, showing the pawl in an extended position and engaged with and raising the deck of the EDP.
Figure 13:
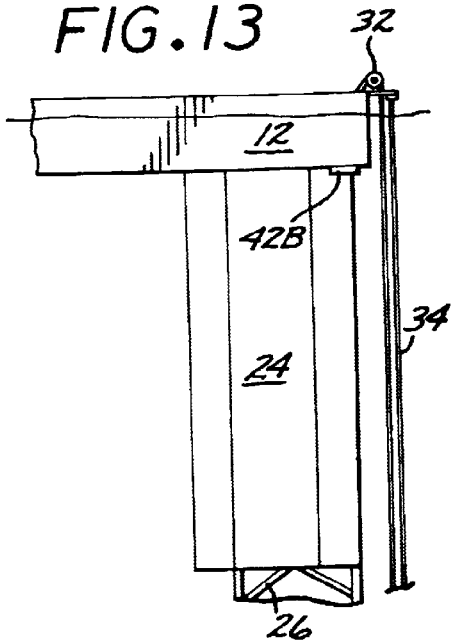
FIG. 13 is a partial elevation view similar to FIG. 11, except showing shear pawls on the fully lowered leg floats being lifted into engagement with the deck by the chain winches.
Figure 14:
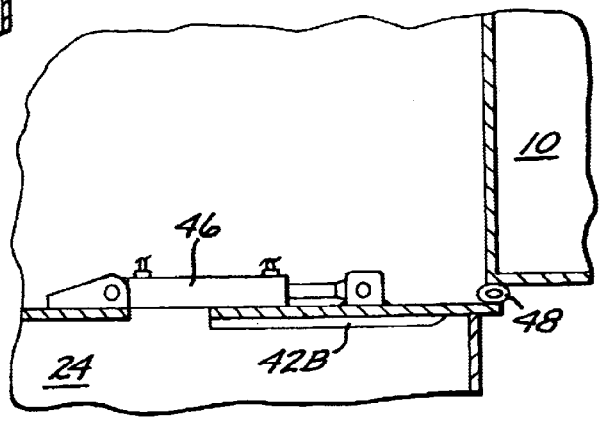
FIG. 14 is a partial cross-sectional view similar to FIG. 12, but showing one of the shear pawls of FIG. 13 being lifted into engagement with the deck; and, FIG. 15 is an elevation view of the EDP with deck shown raised to a selected height above the water by the fully extended, de-ballasted legs.

The compression pawls 42A, six per leg float 24, as shown in the exemplary embodiment of FIG. 5, are recessed in pockets 44 on the sides of the floats, and are hinged for rotational movement between a retracted position, as illustrated in FIG. 6, which permits relative vertical movement between the legs 20 and the deck 12, and an extended position, in which they can be engaged with the deck to prevent further relative vertical movement between the legs and the deck, as illustrated in FIG. 12. Alternatively, the leg floats 24 can each incorporate three or more shear pawls 42B, as illustrated in the exemplary embodiment of FIG. 8, which are captivated on top of the respective floats for translational movement between the retracted and the extended positions thereof, as illustrated in FIGS. 9 and 14, respectively. In either case, the pawls 42A and 42B function to engage a lower surface of the deck 12 to prevent further upward movement of the legs 20 relative to the deck, as illustrated in FIGS. 12 and 14, respectively. In addition, either type of pawl 42A or 42B can be retracted and extended either manually, or more preferably, with hydraulic or pneumatic actuators 46, as illustrated in the figures.

Figure 10:
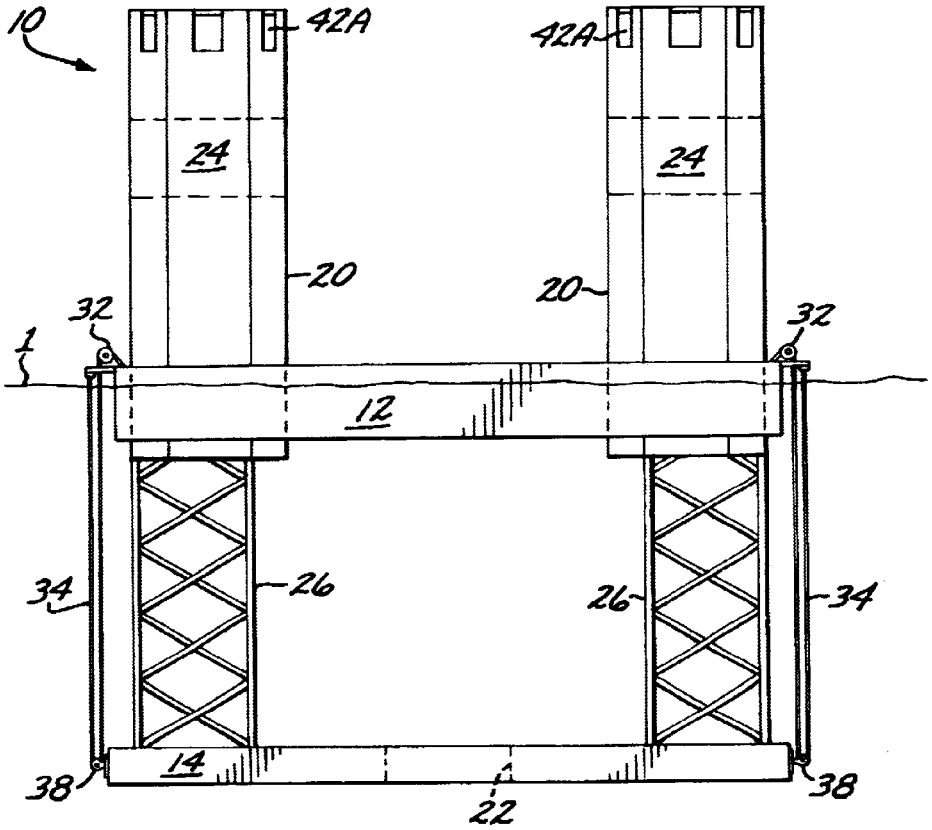
FIG. 10 is an elevation view of the EDP showing the pontoon and legs being lowered.
Figure 11:
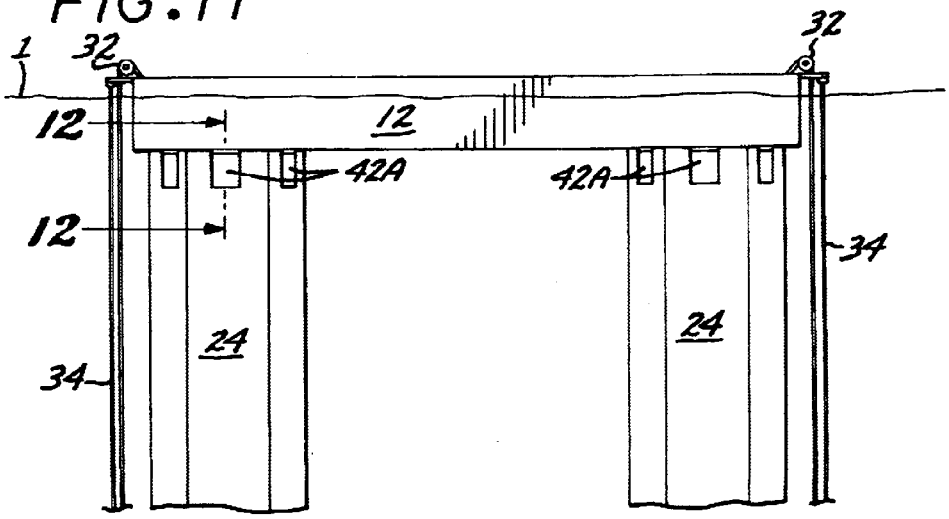
FIG. 11 is a partial elevation view of the EDP showing compression pawls on the fully lowered leg floats being lifted into engagement with the deck by the chain winches.

The EDP 10 is thus extended to its working configuration at the first offshore location by the following method. The buoyancy of the pontoon 14 and the leg floats 24 is first reduced, viz., by ballasting them with sea water, such that they begin to sink below the deck 12. The chains 34 are simultaneously wound out with the winches 32 while maintaining an always-positive tension in the chains to prevent them from slackening, so that the deck 12 is floated onto the surface 1 of the water 2, while the pontoon 14 and the leg floats 24 sink below the surface to respective selected depths, as illustrated in FIG. 10. The lowering step is halted when the pawls 42A or 42B at the respective upper ends of the leg floats 24 are positioned just below the pawl-engagement surfaces of the deck 12, and the winches 32 can be programmed to stop the lowering step automatically at this predetermined, fully extended position of the legs 20.

Figure 15:
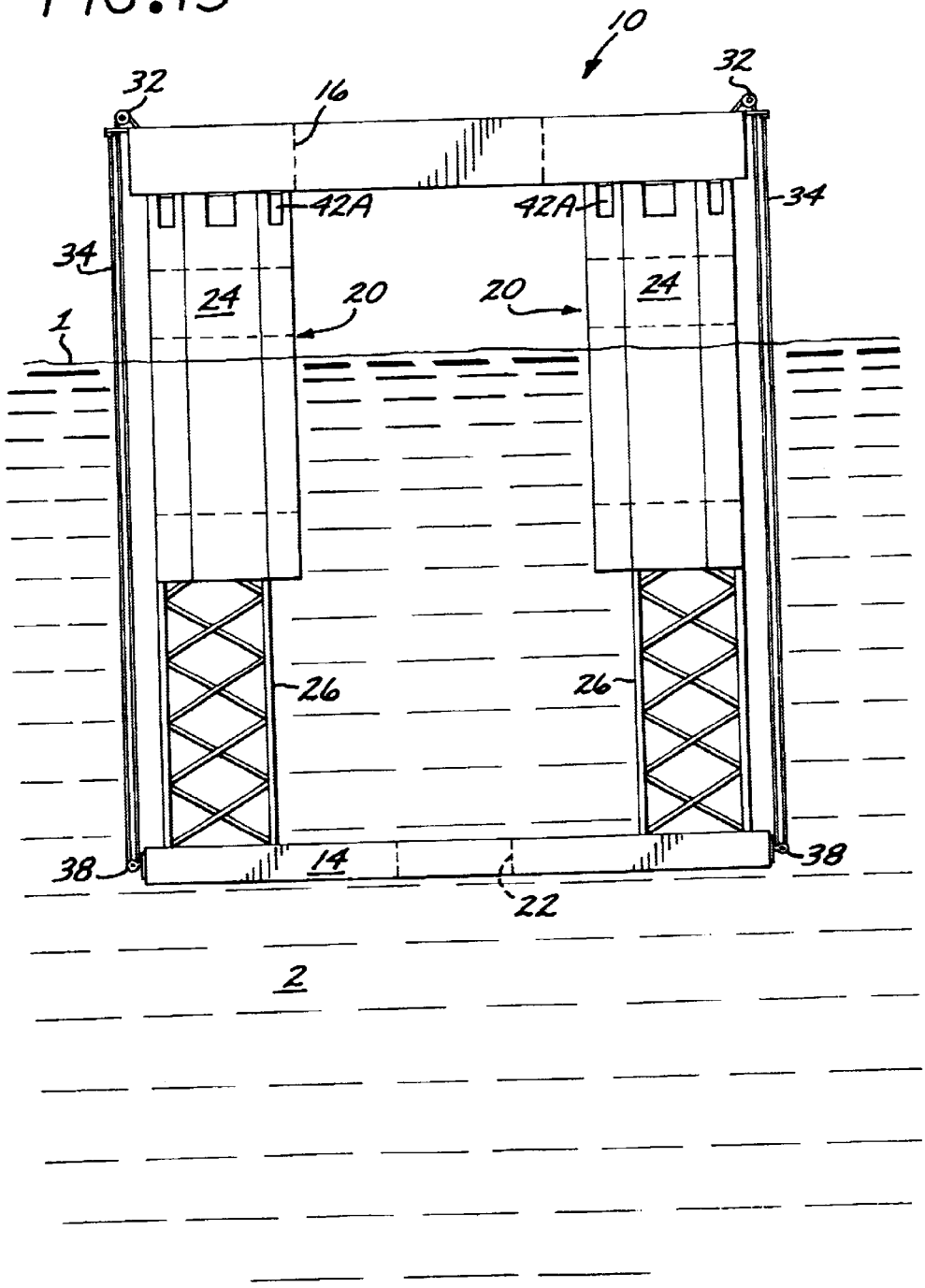

The pawls 42A or 42B on the leg floats 24 are then moved to their extended position, as shown in FIGS. 12 and 14, respectively, and the chains 34 are then wound back in with the winches 32 such that the pontoon 14 and the legs 20 are thereby conjointly raised back up toward the deck 12, until the pawls 42A or 42B engage the deck, as illustrated in FIGS. 11-14, thereby preventing further relative movement between the legs and the deck. The buoyancy of at least one of the pontoon 14 and the leg floats 24, preferably the latter, is then increased by deballasting them such that the deck 12 is raised to a selected working height above the surface 1 of the water 2, as illustrated in FIG. 15.

In one exemplary preferred embodiment of the EDP 10, means 48 are provided between the deck 12 and the pawls 42A or 42B for distributing the load imposed by the deck on respective ones of the leg floats 24 more uniformly around the circumference thereof when the pawls engage the deck. In the particular exemplary embodiment illustrated in FIGS. 6, 9, 12 and 14, these means comprise "crush tubes" 48 disposed between the pawls 42A or 42B and the deck 12, which are compressed, as shown in FIGS. 12 and 14 respectively, as the respective pawls assume the weight of the deck during the step of raising the deck above the water. Alternatively, the load distribution means 28 may comprise springs, elastomeric pads, ductile metal blocks, hydraulic rams, or a sandwich of ductile and stiff metals.

After the EDP 10 has been extended to the above "working" configuration, it is towed to an offshore well site having a plurality of mooring lines anchored to the seabed around it. There, the deck 12 is connected to the leg floats 24 in a more permanent manner, e.g., by welding, to prevent relative movement between the deck and the legs 20 independently of the tension in the mooring chains 34. The distal ends of the mooring chains 34 can then be disconnected from the deck beckets 40 and reconnected to the ends of respective ones of the mooring lines (not illustrated) such that the extended EDP 10 can be maintained in a selected working position over the well site with the winches 32 in a known manner.

As will by now be evident to those of skill in this art, the EDP deployment method of the present invention affords many advances over platforms of the prior art. The method enables the EDP 10 to be assembled and commissioned quickly in a retracted, shallow draft configuration suitable for outfitting and towing in shallow coastal waters, and then easily and rapidly reconfigured in deeper offshore waters to a deep-draft, low-motion platform using simple, onboard ballasting and mooring equipment, without the need for auxiliary vessels or equipment, thereby resulting in a more rapid, cost-effective, and less risky platform deployment.

For example, the method enables the platform to be deployed in a relatively short time period, or "weather window," i.e., a short period of calm, of a type that occurs during those months in which more adverse offshore weather conditions generally prevail, such as during the winter months in the Gulf of Mexico, where other types of platforms cannot be deployed because there are not enough contiguous, relatively calm days to complete the installation process.

As will also be apparent, many variations and modifications are possible in terms of the methods, materials and design of the present invention without departing from its scope. For example, the deployment method is fully reversible, such that the EDP can be quickly retracted and moved rapidly to another well site, or to an inshore location for a quick refurbishment. Accordingly, the scope of the present invention should not be limited to the particular embodiments described and illustrated herein, as these are merely exemplary in nature, but rather, should be commensurate with that of the claims appended hereafter, and their functional equivalents.

What is claimed is:

1. A method for deploying an extendable draft platform for offshore oil and gas production, the method comprising:

providing a buoyant equipment deck having a plurality of leg openings therethrough and a plurality of winches thereon, each winch having a proximal end of a chain wound thereon and a distal end of the chain extending therefrom;

providing an adjustably buoyant pontoon having a plurality of fairleads thereon and a plurality of legs extending therefrom, each leg including a portion comprising an adjustably buoyant float;

placing the deck on the pontoon such that the deck is supported by the pontoon and each of the legs extends above the deck through a respective one of the leg openings;

reeving the distal ends of the chains through corresponding ones of the fairleads and then connecting said ends to the deck;

winding the chains in with the winches such that the deck is tightly coupled to and floatably supported by the pontoon; and, moving the deck and pontoon as a tightly coupled unit over a surface of a body of water to a first offshore location.

2. The method of claim 1, further comprising:

providing pawls on each of the leg floats, the pawls being movable between a retracted position disengaged from the deck and permitting relative movement between the legs and the deck, and an extended position engagable with the deck and preventing relative movement between the legs and the deck when engaged therewith;

reducing the buoyancy of the pontoon and the leg floats such that they begin to sink;

winding the chains out with the winches while maintaining a positive tension in the chains such that the deck is floated onto the surface of the water while the pontoon and the leg floats sink below the surface of the water to respective selected depths;

moving the pawls on the leg floats to the extended position;

winding the chains back in with the winches such that the pontoon and the legs are pulled toward the deck and the pawls engage the deck, thereby preventing further relative movement between the legs and the deck; and, increasing the buoyancy of at least one of the pontoon and the leg floats such that the deck is raised to a selected height above the surface of the water.

3. The method of claim 2, further comprising:

providing a plurality of mooring lines anchored to a seabed around an offshore well site;

moving the elevated deck and submerged pontoon to the well site;

connecting the deck to the leg floats such that relative movement between the deck and the legs is prevented;

disconnecting the distal ends of the chains from the deck and then connecting said ends to respective distal ends of corresponding ones of the mooring lines; and, maintaining the deck and the pontoon in a selected position over the well site with the winches.

4. The method of claim 2, wherein providing the pawls on the leg floats comprises:

hinging the pawls on the leg floats for rotational movement between the retracted and the extended positions thereof.

5. The method of claim 2, wherein providing the pawls on the leg floats comprises:

captivating the pawls on the leg floats for translational movement between the retracted and the extended positions thereof.

6. The method of claim 2, wherein tensioning the chains with the winches such that the pawls engage the deck comprises:

providing means between the deck and the pawls for distributing a load imposed by the deck on respective ones of the leg floats uniformly around a circumference of the respective floats when the pawls engage the deck.

7. The method of claim 6, wherein the load distribution means comprises crush tubes, springs, elastomeric pads, ductile metal blocks, hydraulic rams or a sandwich of ductile and stiff metals.

8. The method of claim 1, wherein moving the deck and pontoon over a surface of a body of water to a first offshore location comprises:

loading the tightly coupled deck and pontoon on a heavy lift vessel ("HLV"); and, shipping the deck and pontoon to the first location aboard the HLV.

9. The method of claim 1, wherein moving the deck and pontoon over a surface of a body of water to a first offshore location comprises:

towing the tightly coupled deck and pontoon over the surface of the water to the first location.

10. The method of claim 3, wherein connecting the deck to the leg floats comprises:

welding the deck to the leg floats.

* * * * *